US005414944A

United States Patent [19]

Culp et al.

[11] Patent Number: 5,414,944

[45] Date of Patent: May 16, 1995

[54] METHOD AND APPARATUS FOR DECREASING SEPARATION ABOUT A SPLITTER PLATE IN A KILN SYSTEM

[76] Inventors: George Culp, 318 S. Main St., New London, Stanley County, N.C. 28127; Robert T. Nagel, 6309 Valley Estates Dr., Raleigh, Wake County, N.C. 27612

[21] Appl. No.: 147,080

[22] Filed: Nov. 3, 1993

[51] Int. Cl.[6] ..... F26B 21/02

[52] U.S. Cl. ..... 34/218; 34/231

[58] Field of Search ..... 34/210, 212, 218, 219, 34/223, 231, 396, 201, 222, 241, 443, 487, 84; 454/263, 284

[56] References Cited

U.S. PATENT DOCUMENTS

| | | | |
|---|---|---|---|
| 15,316 | 3/1922 | Weiss . | |
| 217,022 | 7/1879 | Robbins . | |
| D. 328,137 | 7/1992 | Warren et al. | D25/22 |
| 473,116 | 3/1892 | Hay . | |
| 528,496 | 10/1894 | Williams . | |
| 555,067 | 2/1896 | Bemis . | |
| 620,114 | 2/1899 | Ferrell . | |
| 620,869 | 3/1899 | Horton . | |
| 942,150 | 12/1909 | Tiemann . | |
| 1,054,597 | 2/1913 | Moore . | |
| 1,212,583 | 1/1917 | Tanner . | |
| 1,276,979 | 8/1918 | Sidman . | |
| 1,328,662 | 1/1920 | Fish, Jr. . | |
| 1,339,374 | 5/1920 | Buensod . | |
| 1,432,248 | 10/1922 | Hirt . | |
| 1,467,306 | 9/1923 | Carrier . | |
| 1,497,362 | 6/1924 | Dhe . | |
| 1,539,817 | 5/1925 | Thelen . | |
| 1,541,433 | 6/1925 | Nikaido . | |
| 1,594,549 | 8/1926 | Noel . | |
| 1,603,103 | 10/1926 | Anderson . | |
| 1,693,395 | 11/1928 | Lawton . | |
| 1,840,523 | 1/1932 | Mueller . | |
| 1,863,943 | 6/1932 | Rubin . | |
| 1,919,646 | 7/1933 | Woolhouse . | |
| 1,972,346 | 9/1934 | Juline . | |
| 1,995,675 | 3/1935 | Furbush | 34/222 |
| 2,085,634 | 6/1937 | Cobb . | |
| 2,213,668 | 9/1940 | Dundas et al. . | |
| 2,315,285 | 3/1943 | Dennington . | |
| 2,318,027 | 5/1943 | Sykes et al. | 34/26 |
| 2,388,184 | 10/1945 | Ripper . | |
| 2,448,288 | 8/1948 | Alk . | |
| 2,538,888 | 1/1951 | Smith . | |
| 2,718,713 | 9/1955 | Bloxham . | |
| 2,736,108 | 2/1956 | Muyderman | 34/231 |
| 2,825,274 | 3/1958 | Kurth et al. | 454/261 |
| 3,149,932 | 9/1964 | Bachrich . | |
| 3,337,967 | 8/1967 | Smith . | |
| 3,386,186 | 6/1968 | Tiefenbach . | |
| 3,598,067 | 8/1971 | Jones . | |
| 3,659,352 | 5/1972 | Cook . | |
| 3,675,600 | 7/1972 | Jones . | |
| 3,680,219 | 8/1972 | Koch . | |
| 3,716,004 | 2/1973 | Jones . | |
| 3,900,957 | 8/1975 | Denton et al. . | |
| 4,014,107 | 3/1977 | Bachrich . | |
| 4,188,878 | 2/1980 | Kahnau . | |
| 4,199,870 | 4/1980 | Arsenault . | |
| 4,250,629 | 2/1981 | Lewis . | |
| 4,343,095 | 8/1982 | Rosen et al. . | |
| 4,380,877 | 4/1983 | Poux | 34/225 |
| 4,663,860 | 5/1987 | Beall . | |
| 4,788,777 | 12/1988 | Davis . | |
| 4,955,146 | 9/1990 | Bollinger . | |
| 4,972,604 | 11/1990 | Breckenridge . | |

*Primary Examiner*—Henry A. Bennett
*Assistant Examiner*—William C. Doerrler
*Attorney, Agent, or Firm*—Bell, Seltzer, Park & Gibson

[57] ABSTRACT

The kiln system for drying green lumber to a predetermined moisture content according to the present invention includes a kiln chamber for enclosing a charge of lumber, a fan in upper portions of the kiln chamber above the stacks of lumber to circulate air through the kiln chamber and through the lumber in the kiln chamber and an elongate splitter plate extending laterally from a leading edge in upper portions of the kiln chamber downwardly toward a sidewall of the kiln chamber to a trailing edge. The splitter plate includes a curved portion between the leading edge and the trailing edge for directing the circulating air along the splitter plate and then downward about a rectangular stack of lumber in the kiln chamber. The splitter plate further includes a number of projections extending outwardly from the leading edge for creating vortices in the air circulated by the fan. The increased vorticity of the air helps the circulating air to more closely follow the surface of the splitter plate downwardly about the lumber.

44 Claims, 2 Drawing Sheets

METHOD AND APPARATUS FOR DECREASING SEPARATION ABOUT A SPLITTER PLATE IN A KILN SYSTEM

FIELD OF THE INVENTION

The present invention relates to the field of kiln drying and, more particularly, to a method and apparatus of kiln drying which includes a splitter plate for improved air circulation.

BACKGROUND OF THE INVENTION

Lumber which has recently been cut and machined contains a relatively large percentage of water and is referred to as green lumber. Prior to being used in construction or other applications which demand selected grades of lumber, the green lumber must be dried to remove a relatively large percentage of water. Acceptable water content will vary with the application as well as the type of wood, however, in many circumstances, a moisture content of 19% or less is acceptable.

Although lumber may be air dried, kiln drying accelerates and provides increased control over the drying process. In kiln drying, a charge of lumber is placed in a kiln chamber. A typical kiln chamber is a generally rectangular building which can be sealed to control the introduction and exhaust of air. Further, such kiln chambers typically have reversible fans for circulating the air through the chamber.

The charge of lumber placed in the kiln generally consists of a number of rectangular solid stacks of lumber. Each stack of lumber, in turn, typically consists of a number of vertically stacked, horizontal rows of lumber that form a rectangular solid. The horizontal rows are spaced apart for air to pass between the rows using wooden boards referred to as "stickers" that have a relatively small lateral cross-sectional area in relation to the lateral cross-sectional area of the lumber forming the charge. The stickers are generally spaced apart between each horizontal row to allow air to flow between the rows.

Typically, the stacks of lumber are placed on separate wheeled, flat bed cars which are mounted for movement on railroad-type tracks. Kilns may have any desired number of tracks. Multi-track kilns may therefore accept several stacks of lumber during each drying cycle.

In operation, a charge of green lumber is initially placed in a kiln chamber. After sealing the kiln chamber, the air within the kiln is heated to facilitate drying. The air may be heated in a number of ways such as by heat transfer from pipes extending through the kiln chamber in which steam flows. Alternatively, heated air may be introduced such as from a furnace. Kilns which utilize the introduction of heated air are typically referred to as direct fired kilns.

Fans are generally positioned in upper portions of the kiln and above the stacked lumber to circulate the heated air through the kiln chamber, including the stacks of lumber. Because the stickers provide spacing between the horizontal rows of lumber, the heated air passes between the rows of lumber and is in direct contact with both the upper and lower surfaces of the individual pieces of lumber. The fans continually recirculate the air through the kiln and the lumber to further dry the lumber. Periodically, a portion of the circulating air is exhausted from the kiln and additional air is introduced into the kiln. The additional air is typically heated in the kiln chamber, such as by heat transfer from the steam pipes. This periodic exhaust and replacement process allows circulating air which has absorbed a large amount of moisture from the green lumber to be removed, while drier air is introduced to accelerate the lumber's drying.

Within such kilns, the circulating air flows in a generally circular pattern. More particularly, fans above the stacks of lumber direct air laterally over the top of the lumber in a first direction. When the air contacts a first sidewall of the kiln chamber, the bulk of the air is forced downward by the fans and the ceiling of the kiln chamber. The circulating air subsequently flows through the spaces between the horizontal rows of lumber established by the stickers in a second, lateral direction opposite the first lateral direction. Upon contact with a second sidewall of the kiln chamber, the air rises and is recirculated by the fans through the lumber. Periodically, the fans are reversed such that the air flows in the opposite direction to provide generally consistent drying of the lumber.

Kiln chambers are generally rectangular in lateral cross-section. In addition, the fans located in upper portions of the kiln chamber each include a plurality of fan blades having an axis of rotation. The axis of rotation of each is fan is typically substantially perpendicular to the generally vertical sidewalls of the kiln chamber. Consequently, the air circulated by the fans flows in a direction substantially perpendicular to the sidewalls of the kiln chamber. Thus, instead of circulating downward along a sidewall of the kiln chamber and then through a stack of lumber, a portion of the air circulated by the fans is deflected from the sidewalls. The deflected air typically remains in upper portions of the kiln chamber and does not pass over the surface of the lumber thus reducing the extent to which the circulating air draws moisture from the green lumber.

In order to improve airflow, splitter plates have been incorporated in kiln chambers to direct the flow pattern of air circulated by the fans downwardly about the stacks of lumber. Typical splitter plates extend longitudinally throughout the length of the kiln chamber and laterally from a leading edge in upper portions of the kiln chamber downwardly toward a sidewall of the kiln chamber to a trailing edge. The leading edge of conventional splitter plates is laterally spaced from the fan, but is positioned so as to receive and direct at least a portion of the air circulated by the fans.

Typical splitter plates also have a curved portion between the leading edge and the trailing edge for directing the circulating air downward about the stacks of lumber in the kiln chamber. The curved portion of conventional splitter plate has upper and lower surfaces over which air is passed. The air directed along the lower surface is generally guided along the splitter plate due, at least in part, to the upward movement of the heated air against the lower surface of the splitter plate. This air is also guided along the lower surface of conventional splitter plates by the generally upward movement of the swirling air circulated by the fans at the time the air initially contacts the lower surface.

The portion of circulating air which contacts and is to be guided by the upper surface of conventional splitter plates, however, does not follow the contour of the upper surface of the splitter plate. Instead, through a phenomenon termed "separation" a portion of the circulating air flowing along the upper surface separates from the splitter plate and remains in upper portions of the kiln chamber. Separation produces gross inefficiencies within any fluid system, including a kiln drying system. Thus, although conventional splitter plates improve the downward circulation of air about the rectangular stacks of lumber, a portion of the air circulated by the fans separates from a splitter plate and remains in upper portions of the kiln chamber so as to not flow across the surface of the lumber.

Accordingly, for a given period of time, less lumber can be dried in a kiln chamber in which a portion of the air circulated by the fans separates from a splitter plate and remains in upper portions of the kiln chamber than in a kiln chamber in which all of the circulating air flows through the stacks of lumber. Alternatively, the same amount of lumber may be dried, but in a longer length of time in a kiln chamber in which a portion of the air circulated by the fans separates from a splitter plate and remains in upper portions of the kiln chamber than in a kiln chamber in which all of the circulating air flows over the surface of the lumber. Since it is expensive and time consuming to heat the air to dry the lumber, the resultant increase in drying time and the decrease in drying capacity of the kiln chamber significantly increases the expense of kiln drying.

OBJECT AND SUMMARY OF THE INVENTION

Accordingly, it is an object of the present invention to provide an improved splitter plate for a lumber drying kiln which provides an improved airflow pattern downward about the stacks of lumber for the air circulated by the fans.

In one embodiment, an elongate splitter plate extends laterally from a leading edge in upper portions of the kiln chamber downwardly toward a sidewall of the kiln chamber to a trailing edge. The leading edge includes means for generating a plurality of vortices in the air circulated by the fan. The vortices created by the vortex generating means help the circulating air to more closely follow the surface of the splitter plate downwardly about the rectangular stacks of lumber in the kiln chamber to thereby increase the efficiency of the airflow within the kiln chamber and to improve the drying process.

In another embodiment, the leading edge of a splitter plate includes a plurality of spaced apart projections extending laterally inward toward the fans. The projections are preferably a plurality of sawtooth-shaped projections to generate the plurality of air vortices.

In yet another embodiment, first and second elongate splitter plates extend laterally outward from opposite sides of the fans. Both the first and second splitter plates extend from a leading edge in upper portions of the kiln chamber downwardly toward opposed sidewalls of the kiln chamber to trailing edges. The first and second elongate splitter plates direct the circulating air downwardly about the rectangular stacks of lumber to increase the efficiency of airflow within the kiln chamber and to improve the drying process.

The foregoing and other objects, advantages and features of the invention, and the manner in which the same are accomplished, will be more readily apparent upon consideration of the following detailed description of the invention taken in conjunction with the accompanying drawings, which illustrate preferred and exemplary embodiments, and wherein:

DETAILED DESCRIPTION OF THE PREFERRED EMBODIMENT

Figure 1:
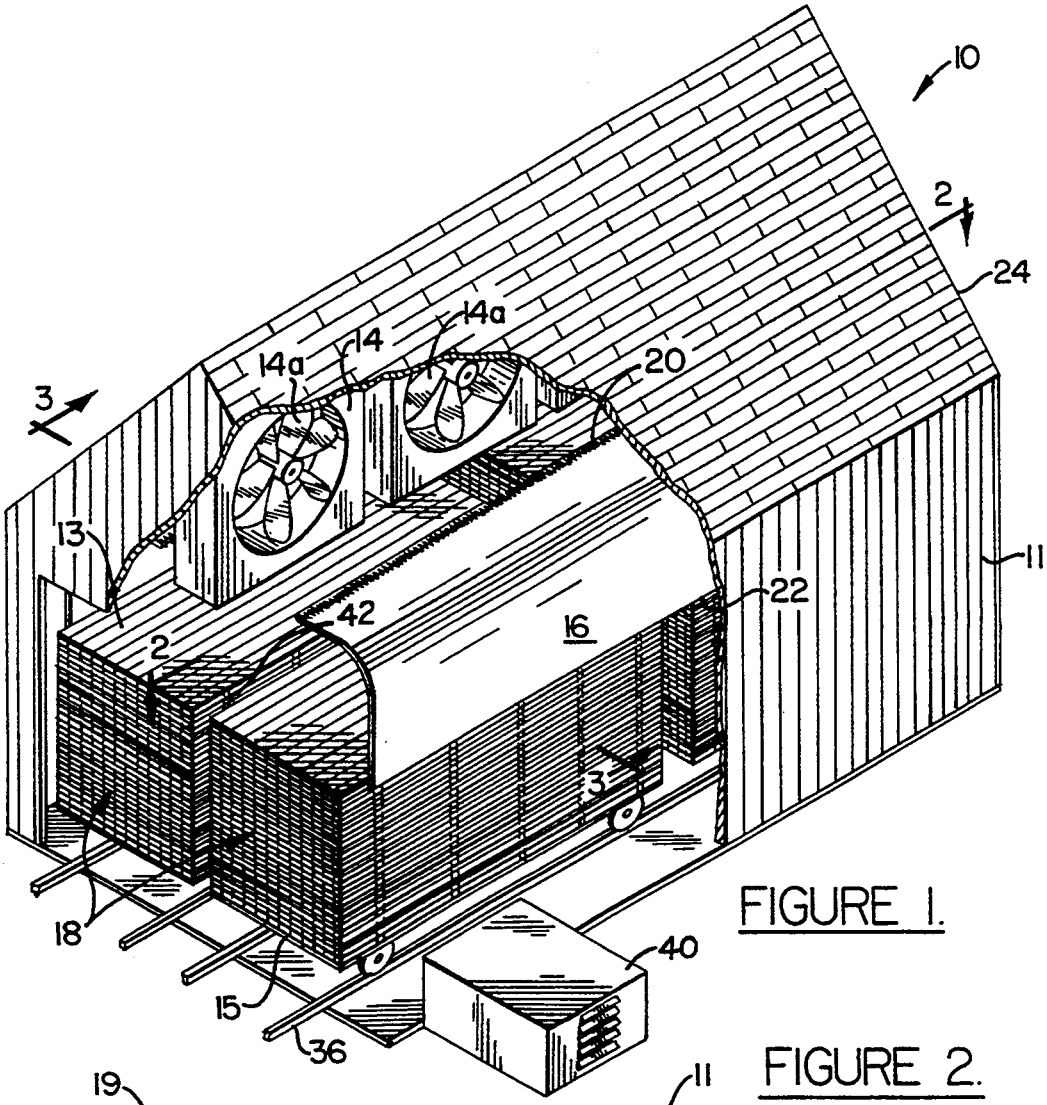
FIG. 1 is a fragmented perspective view of a kiln system according to the present invention.

The present invention is a method, and apparatus for improving the circulation of air through a kiln chamber and, consequently, increasing the efficiency with which green lumber is dried. As illustrated in FIG. 1, a kiln chamber 10 for drying lumber is illustrated. The kiln chamber 10 has a lower portion defining a generally rectangular solid space for enclosing a charge of lumber. The charge of lumber consists of a plurality of rectangular solid stacks of lumber 18. It will be understood, however, that the phrase "rectangular solid" is used descriptively, rather than as a limitation, and represents the general interior shape of a typical kiln, or the portion of some other shape of kiln that will hold a stack of lumber to be dried.

In one embodiment, the plurality of rectangular solid stacks of lumber 18 may be laterally spaced apart within the kiln chamber. Accordingly, one rectangular solid stack of lumber is outermost with respect to each vertical sidewall 11 of the kiln chamber 10. In addition, each rectangular solid stack of lumber typically has opposed inner and outer surfaces 17 and 19, respectively, as well as upper and lower surfaces 13 and 15, respectively.

Figure 2:
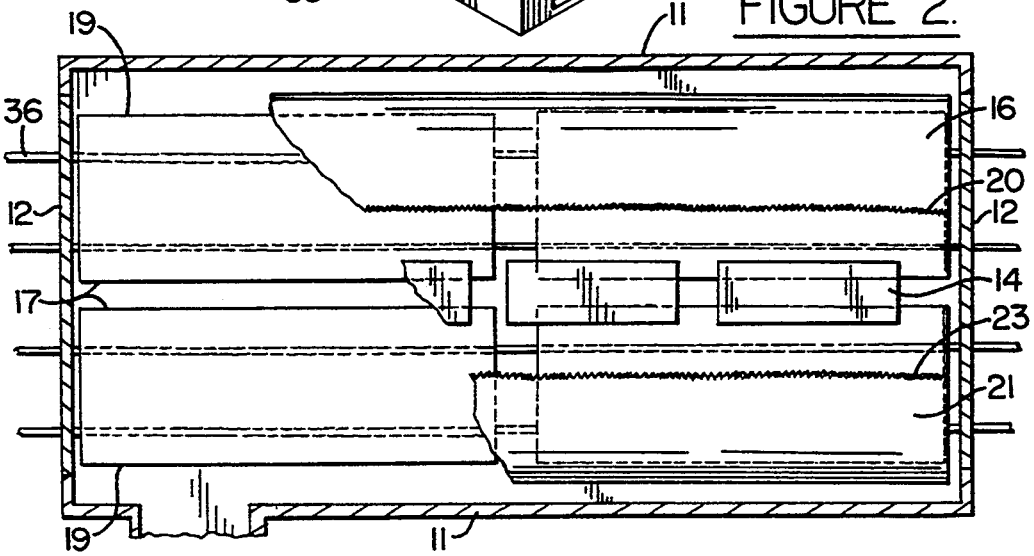
FIG. 2 is a cross-sectional plan view of the kiln system according to the present invention taken along line 2—2 of FIG. 1.

The kiln chamber 10 also preferably includes a set of doors 12 on one sidewall 11 of the kiln chamber 10 and, more preferably, two sets of doors 12 on opposed sidewalls 11. The doors 12 allow lumber to be inserted and withdrawn from the kiln chamber 10. For a kiln chamber 10 having two sets of doors 12 on opposed sidewalls 11 as illustrated in FIG. 2, lumber may be inserted through a first set of doors and withdrawn from a second set of doors, thus increasing the efficiency of the lumber handling. The doors 12 also allow the kiln chamber 10 to be sealed to control the introduction and exhaust of air.

The kiln chamber 10 also includes at least one fan 14 including a plurality of outwardly extending fan blades 14*a* which rotate about axis of rotation. More preferably, the kiln chamber 10 includes a plurality of longitudinally spaced fans 14 for circulating air laterally through the kiln chamber 10. The axis of rotation of each of the plurality of longitudinally spaced fans 14 is preferably parallel and coplanar. The fans 14 are generally positioned in upper portions of the kiln chamber 10 above the generally rectangular solid space. The fans 14 circulate air through the kiln chamber 10 and the lumber in the kiln chamber 10 in order to draw moisture from the lumber to dry the lumber to an acceptable moisture level. The fans 14 are also preferably reversible to allow the direction of airflow through the kiln chamber 10 to be altered so as to more evenly dry the lumber.

According to the present invention, the kiln chamber 10 includes an elongate splitter plate 16 for improving the circulation of air through the kiln chamber 10 and through the stacks of lumber 18. This improvement in the air circulation increases the efficiency with which the lumber is dried and correspondingly decreases the time and expense in which identical quantities of lumber may be dried to identical moisture levels. The elongate splitter plate 16 extends laterally outward from a first edge 20 in upper portions of the kiln chamber 10 downwardly toward a sidewall 11 of the kiln chamber 10 to a trailing edge 22. The elongate splitter plate 16 also includes a curved portion 24 between the first edge 20 and a second edge 22 for directing the air circulated by the fans 14 along the splitter plate 16 and then downward about the rectangular stacks of lumber 18 placed in the kiln chamber 10 for drying. As illustrated, the elongate splitter plate 16 is aligned to follow the intended flow path of the circulating air.

Based upon the embodiment of the present invention in which air is circulated by the fan 14 in the direction of the first edge 20, the first edge will hereafter be referred to as the leading edge. Correspondingly, the second edge 22 will be referred to as the trailing edge. It will be understood that in embodiments in which the direction of airflow generated by the fans 14 is reversed, however, the second edge 22 would be the leading edge and the first edge 20 would be the trailing edge.

The leading edge 20 of the splitter plate 16 includes means for generating a plurality of vortices in the air circulated by the fan 14. The vortices created by the vortex generating means help the circulating air to more closely follow the surface of the splitter plate 16 downwardly about the rectangular stacks of lumber 18 to thereby increase the efficiency of the airflow within the kiln chamber 10 and to improve the drying process.

As illustrated in FIGS. 1 and 2, the vortex generating means preferably includes a plurality of spaced apart projections 26 extending laterally inward toward the fans 14. Alternatively, the vortex generating means may include a plurality of vanes extending outwardly from the curved portion 24 of the splitter plate 16 at the leading edge 20. The kiln drying system and method of the present invention may also include other vortex generating means known to those skilled in the art.

Figure 5:
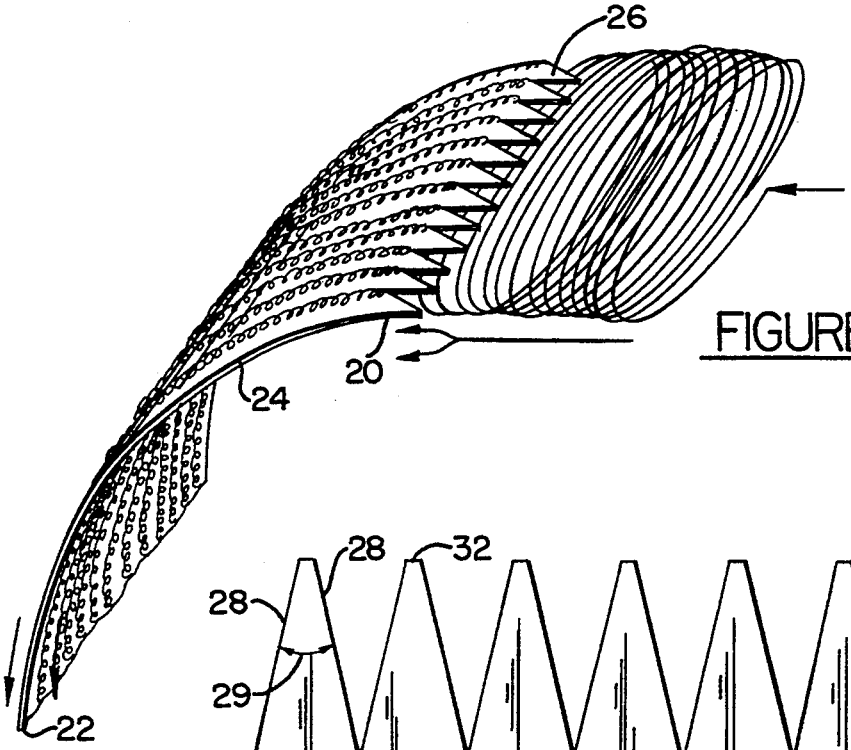
FIG. 5 is a perspective view of a splitter plate according to the present invention.
Figure 6:
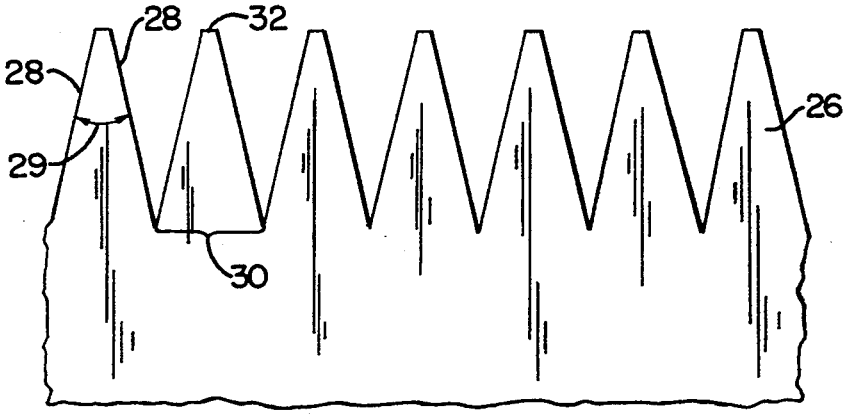
FIG. 6 is a fragmented perspective view of the spaced apart projections extending from the leading edge of the splitter plate illustrated in FIG. 5.

As best illustrated in FIGS. 5 and 6, the projections 26 preferably include a plurality of sawtooth-shaped projections having opposed side edges 28. The opposed side edges 28 of the sawtooth-shaped projections 26 preferably define an interior angle 29 of between about 16° and about 30°. Most preferably, the opposed side edges 28 of the sawtooth-shaped projections 26 define therebetween an interior angle of about 25°.

The sawtooth-shaped projections 26 extend laterally inward from a relatively broad first portion 30 to a relatively narrow second portion 32. The width of the relatively broad first portion 30 is preferably between about 5 inches and 8 inches and, more preferably, is about 6.75 inches. The width of the relatively narrow second portion 32 of the sawtooth-shaped projections 26 is preferably about 1 inch. Although sawtooth-shaped projections 26 having a relatively narrow second portion 32 are illustrated, the projections 26 may extend laterally inward from a relatively broad first portion 30 to a point if desired. The length of the sawtooth-shaped projections may also be varied as desired. In preferred embodiments, the length of the sawtooth-shaped projections 26 is between about 6 inches and about 18 inches. Mere preferably, the length of the sawtooth-shaped projections 26 is about 13 inches.

The curved portion 24 of the elongate splitter plate 16 is preferably concave relative to the rectangular stacks of lumber 18 in the kiln chamber 10. More preferably, the curved portion 24 of the elongate splitter plate 16 extends radially through a substantially semi-circular arc of about 90° from a horizontally disposed leading edge 20 to a vertically disposed trailing edge 22.

The length of the curved portion 24 may be varied as desired based upon the size of the kiln chamber be and the positions of the fans 14 and the stacks of lumber 18. In a preferred embodiment, however, the splitter plate 16 extends from a leading edge 20 which is coplanar with the rotational axis of the fans 14 to a trailing edge 22. Accordingly, the air circulated by the fans 14 divides and is guided substantially evenly by both the upper and lower surfaces **24*a* and 22*b* of the elongate splitter plate 16. The trailing edge 22 is preferably positioned substantially horizontal with the upper surface 13 of lumber of the outermost stack of lumber in the kiln chamber 10. The trailing edge 22 is also preferably positioned between the outer side surface 19 of the outermost stack of lumber and a sidewall 11 of the kiln chamber 10. The trailing edge 22 is more preferably positioned about 40% to about 60% of the lateral distance and, most preferably, about 50% of the lateral distance from the side surface 19 of the outermost stack of lumber to a sidewall 11 of the kiln chamber 10**.

The increased vorticity created by the vortex generating means helps the circulating air to more closely follow the surface of the splitter plate 16 downwardly about the rectangular stacks of lumber be since the increased vorticity energizes the boundary layer about the splitter plate 16, increases the axial momentum within the boundary layer and prevents separation of the air from the splitter plate 16. It is believed that the increase of axial momentum within the boundary layer about the splitter plate is due, at least in part, to the transfer of momentum from the fluid flow external to the boundary layer. This momentum transfer is a result of the near axial vorticity generated by the sawtooth-shaped projections 26.

More specifically, the boundary layer is the region near the elongate splitter plate 16 in which the motion of the circulating air is affected by the splitter plate 16. The layers of circulating air within the boundary layer and near the upper suction surface **24*a* of the splitter plate 16 are retarded by viscous friction. The air near the upper suction surface 24*a* of the splitter plate 16 is also retarded by the unfavorable pressure gradient formed by the downwardly extending curved portion 24 of the elongate splitter plate 16 which the air, which was originally circulating about the substantially horizontal axis of rotation of the fans 14**, is following.

By increasing the vorticity of the air flowing about the splitter plate 16, i.e., by generating a plurality of air vortices, the boundary layer about the splitter plate 16 is energized and the circulating air passes about and along the upper suction surface of the splitter plate 16 as a turbulent boundary layer having undergone an immediate transition, as opposed to laminar flow. It is our understanding that due to the increased efficiency of momentum transfer in turbulent fluid flow, the velocity, and consequently the axial momentum, of the air near the upper suction surface 24*a* of the elongate splitter plate 16 is increased. The increased velocity and axial momentum of the air near the upper suction surface 24*a* of the splitter plate 16 allows the air to more closely follow the upper suction surface of the splitter plate 16 downwardly about the rectangular stacks of lumber 18 without separating from the upper suction surface 24*a* of the splitter plate 16.

The kiln system of the present invention preferably includes a second elongate splitter plate 21 positioned on the opposite side of the fans 14 from the first elongate splitter plate 16 to direct air circulated by the fans 14 downwardly about the lumber when the rotation of the fans 14 is reversed. The second elongate splitter plate 21 extends laterally outward from a leading edge 23 in upper portions of the kiln chamber be downwardly toward a second opposed sidewall 11 of the kiln chamber be to a trailing edge 25. The second splitter plate 21 also includes a curved portion 27 between the leading edge 23 and the trailing edge 25 for directing the circulating air downward about the rectangular stacks of lumber 18 placed in the kiln chamber be. In addition, the leading edge 23 of the second splitter plate 21 also includes vortex generating means for creating a plurality of vortices of air in the air circulated by the fans 14 to help the circulating air more closely follow the upper surface 27*a* of the second splitter plate 21 downwardly about the rectangular stacks of lumber 18 to thereby increase the efficiency of the airflow and to improve the drying process.

Accordingly, when the fans 14 are operated so as to circulate air in a first direction, the first splitter plate 16 and, in particular, the vortex generating means on the leading edge 20 of the first splitter plate 16, will help the circulating air to circulate downwardly about the rectangular stacks of lumber 18. When the direction of rotation of the fan blades 14*a* is reversed, the second splitter plate 21 and, in particular, the vortex generating means on the leading edge 23 of the second splitter plate 21, will help the circulating air to flow downwardly about the rectangular stacks of lumber 18. In addition, the first and second splitter plates 16 and 21 do not impair the recirculation of air to the fans 14 since the air, after passing across the surface of the lumber, rises to upper portions of the kiln chamber be and is drawn through the fans 14 to be recirculated. Accordingly, the air may rise about the upper and lower surfaces of the splitter plates 16 and 21 and be drawn through the fan without significant obstruction.

The generally rectangular solid stacks of lumber 18 are typically placed on wheeled cars 34, such as flat bed rail cars, mounted on rail tracks 36 which are preferably formed in the floor of the kiln chamber 10. The wheeled cars 34 facilitate insertion and withdrawal of the stacks of lumber 18 from the kiln chamber 10. Although a kiln chamber 10 having two laterally adjacent tracks of lumber is illustrated, one skilled in the art will know that a kiln chamber incorporating the present invention may include one or more tracks of lumber.

Further, since the length of the kiln chamber 10 is typically greater than the length of the pieces of green lumber being dried, the charge of lumber preferably includes a longitudinal row of a plurality of rectangular solid stacks of lumber. Each longitudinal row of lumber is preferably inserted on one track with the wheeled cars 34 upon which the rectangular solid stacks of lumber 18 are carried being coupled together. Accordingly, the longitudinal row of lumber may be inserted and withdrawn as an unit.

Figure 3:
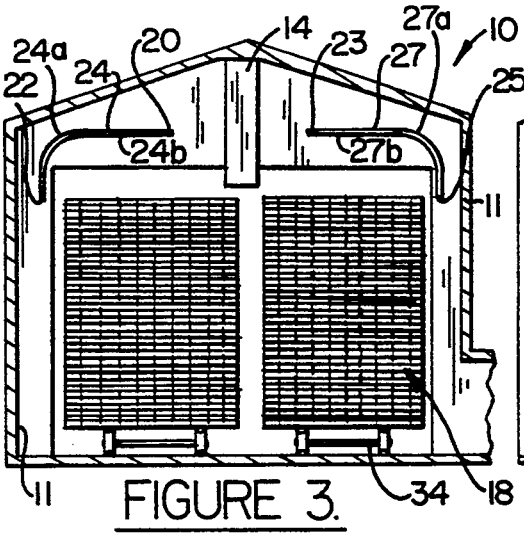
FIG. 3 is a cross-sectional lateral view of the kiln system according to the present invention taken along line 3—3 of FIG. 1.

Regardless of the number of wheeled cars 34 per track, the kiln chamber 10 is adapted to receive a charge of lumber comprised of at least one rectangular solid stack of lumber 18 having a predetermined maximum length. Correspondingly, the length of the first splitter plate 16 is preferably substantially equal to either the predetermined maximum length of the charge of lumber or, if more than one row of lumber is inserted in the kiln chamber 10, the outermost longitudinal rows of lumber 18 relative to the sidewalls 11 of the kiln chamber 10 as illustrated in FIG. 3.

In further preferred embodiments, the kiln system of the present invention also includes means for heating the circulating air in the kiln chamber 10 since the circulation of heated air further accelerates the drying process by withdrawing larger quantities of moisture from the lumber. The heating means may include all those known to one skilled in the art, including, without limitation, an external furnace 40 for heating the air prior to its introduction to the kiln chamber 10. Alternatively, the kiln chamber 10 may include pipes extending through the kiln chamber 10 in which heated steam flows such that heat is transferred from the steam flowing through the pipes to the circulating air within the kiln chamber 10.

Figure 4:
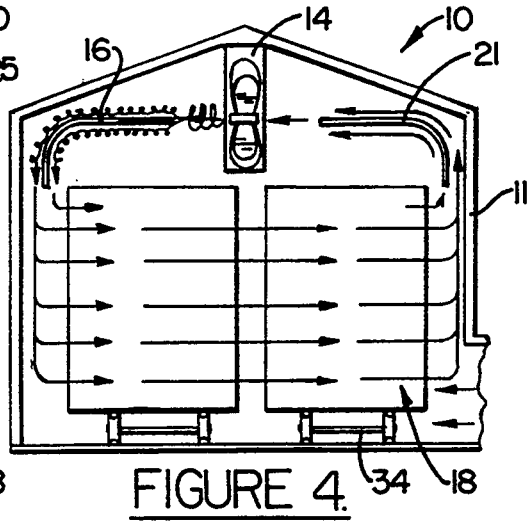
FIG. 4 is a cross-sectional lateral view of the kiln system according to the present invention illustrating a typical air flow pattern through the kiln chamber and through the lumber in the kiln chamber.

In other preferred embodiments illustrated in FIG. 4, the plurality of stacked rows of lumber are spaced apart such that air may flow between the rows to increase the lumber's drying. This spacing is preferably provided by the placement of a plurality of spaced apart stickers 42, typically pieces of lumber having a relatively small cross-sectional dimensions in proportion to the cross-sectional dimensions of the lumber being dried, between each row of lumber.

In operation, a charge of lumber consisting of at least one rectangular solid stack of green lumber 18 having a relatively large moisture content is introduced into the kiln chamber 10 which is subsequently sealed such that air may be controllably introduced into and exhausted from the kiln chamber 10. As illustrated in FIG. 4, the air within the kiln chamber 10 is thereafter circulated through the stack of lumber 18 to draw moisture from the stack. According to the present invention, a plurality of vortices are generated from the air circulated by the fans 14. The increased vorticity of the air helps the circulating air to more closely follow the surface of the splitter plate 16 downwardly about the rectangular stacks of lumber 18, thus increasing the efficiency of the airflow within the kiln chamber and improving the drying process of the green lumber.

In preferred embodiments, at least a portion of the air is recirculated through the stacks of lumber 10 in the kiln chamber 10 to further dry the stacks of lumber 18. This recirculation of air preferably includes the selective exhaust of a portion of the circulating air containing moisture drawn from the stacks of lumber 18 and the introduction of additional air into the kiln chamber 10. Preferably, the additional air has a lower moisture content than the exhausted air such that it will more rapidly draw moisture from the stacks of lumber 18 than the exhausted air, thus, further increasing the efficiency of the drying process. In further preferred embodiments, the air is heated prior to its circulation to further facilitate moisture removal from the stacks of lumber 18. Once the lumber has reached an acceptable moisture level, such as 19% or less, or the lumber has been in the kiln chamber 10 for a predetermined length of time, the doors 12 of the kiln chamber 10 may be opened and the charge of lumber removed.

In the specification, typical preferred embodiments of the invention have been disclosed and, although specific terms have been employed, they have been used in the generic and descriptive sense only and not for purposes of limitation, the scope of the invention being set forth in the following claims.

What is claimed is:

1. A kiln system for drying green lumber to a predetermined moisture content, said kiln system comprising:

a kiln chamber, lower portions of which define a generally rectangular solid space for enclosing rectangular solid stacks of lumber therein for drying;

a fan in upper portions of said kiln chamber and above the generally rectangular solid space for circulating air through said chamber and through lumber in said chamber to thereby dry the lumber;

an elongate splitter plate extending laterally from a leading edge in upper portions of said kiln chamber downwardly toward a sidewall of said kiln chamber to a trailing edge, and with said splitter plate having a curved portion between said leading edge and said trailing edge for directing the circulating air along said splitter plate and then downward about a rectangular stack of lumber placed in said chamber for drying; and means on said leading edge of said splitter plate for generating a plurality of vortices of circulating air in the air circulated by said fan, whereby the vortices created by said vortex generating means more closely follow the surface of said splitter plate downwardly about the rectangular stack of lumber to thereby increase the efficiency of the airflow within said kiln chamber and the drying process.

2. A kiln system according to claim 1 wherein said vortex generating means comprises a plurality of spaced apart projections extending laterally inward toward said fan.

3. A kiln system according to claim 2 wherein projections comprises a plurality of sawtooth-shaped projections having opposed side edges.

4. A kiln system according to claim 3 wherein said opposed side edges of said sawtooth-shaped projections define therebetween an interior angle of between about 16° and about 30°.

5. A kiln system according to claim 3 wherein said sawtooth-shaped projections extend laterally inward from a relatively broad first portion to a narrow second portion and wherein the width of said relatively broad first portion is about 6.75 inches.

6. A kiln system according to claim 3 wherein the width of said relatively narrow second portion of said sawtooth-shaped projections is about 1 inch.

7. A kiln system according to claim 3 wherein the length of said sawtooth-shaped projections is between about 6 inches and about 18 inches.

8. A kiln system according to claim 1 wherein said curved portion of said elongate splitter plate is concave relative to a rectangular stack of lumber in said kiln chamber.

9. A kiln system according to claim 8 wherein said curved portion of said elongate splitter plate extends radially through a substantially semi-circular arc of about 90°.

10. A kiln system according to claim 1 wherein said fan comprises a plurality of blades for rotating about a predetermined axis, and wherein said leading edge of said elongate splitter plate is coplanar with said axis of said fan blades.

11. A kiln system according to claim 1 wherein said leading edge is horizontally disposed and said trailing edge is vertically disposed.

12. A kiln system according to claim 1 wherein said kiln chamber has a length sufficient to receive a charge of lumber comprised of a plurality of rectangular solid stacks of lumber, said charge of lumber having a predetermined maximum length and said elongate splitter plate has a length substantially equal to the predetermined maximum length of said charge of lumber.

13. A kiln system according to claim 1 and further comprising:

a second elongate splitter plate extending laterally from a leading edge in upper portions of said kiln chamber downwardly toward a second opposed sidewall of said kiln chamber to a trailing edge, and with said second splitter plate having a curved portion between the leading edge and the trailing edge for directing the circulating air along said second splitter plate and then downward about a rectangular stack of lumber placed in said chamber for drying; and means on said leading edge of said second splitter plate for generating a plurality of vortices of air in the air circulated by said fan, whereby the vortices created by said vortex generating means on said second splitter plate help the circulating air to more closely follow the surface of said second splitter plate downward about the rectangular stack of lumber to thereby increase the efficiency of the airflow and the drying process.

14. A kiln system according to claim 13 wherein said kiln chamber has a width sufficient to receive a plurality of laterally spaced, rectangular solid stacks of lumber therein for drying in side-by-side relationship, and wherein said first and second elongate splitter plates direct air along said first and second splitter plate, respectively, and then downwardly about the outermost stacks of the plurality of laterally spaced rectangular solid stacks of lumber.

15. The combination of a kiln system for drying green lumber to a predetermined moisture content and a portion of lumber to be dried therein, the combination comprising:

a kiln chamber, lower portions of which define a generally rectangular solid space;

a substantially rectangular solid stack of lumber in the rectangular solid space of said kiln chamber for being dried therein;

a fan in upper portions of said kiln chamber and above the generally rectangular solid space for circulating air through said chamber and through lumber in said kiln chamber to thereby dry the lumber;

an elongate splitter plate extending laterally from a leading edge in upper portions of said kiln chamber downwardly toward a sidewall of said kiln chamber to a trailing edge, and with said splitter plate having a curved portion between said leading edge and said trailing edge for directing the circulating air along said splitter plate and then downward about said rectangular stack of lumber placed in said chamber for drying; and means on said leading edge of said splitter plate for generating a plurality of vortices in the air circulated by said fan, whereby vortices of circulating air created by said vortex generating means more closely follow a surface of said curved portion of said splitter plate downwardly about said rectangular stack of lumber to thereby increase the efficiency of the airflow within said kiln chamber and the drying process.

16. The combination of a kiln system and lumber according to claim 15 wherein said vortex generating means comprises a plurality of spaced apart projections extending laterally inward toward said fan.

17. The combination of a kiln system and lumber according to claim 16 wherein said projections comprise a plurality of sawtooth-shaped projections having opposed side edges and extending laterally inward from a relatively broad first portion.

18. The combination of a kiln system and lumber according to claim 15 wherein said curved portion of said elongate splitter plate is concave relative to said rectangular stack of lumber.

19. The combination of a kiln system and lumber according to claim 18 wherein said curved portion of said elongate splitter plate extends radially through a substantially semi-circular arc of about 90°.

20. The combination of a kiln system and lumber according to claim 15 wherein said rectangular solid stack of lumber comprises inner and outer side surfaces, and wherein the position of said stack in said kiln chamber defines a first distance between said outer side surface of said rectangular solid stack of lumber and a sidewall of said kiln chamber, and wherein said trailing edge of said elongate splitter plate extends between about 40% and about 60% of the first distance from said outer surface of said rectangular solid stack of lumber toward the sidewall of said kiln chamber.

21. The combination of a kiln system and lumber according to claim 15 wherein said kiln chamber has a length sufficient to receive a charge of lumber comprised of a plurality of rectangular solid stacks of lumber, said charge of lumber having a predetermined maximum length and said elongate splitter plate has a length substantially equal to the predetermined maximum length of said charge of lumber.

22. The combination of a kiln system and lumber according to claim 15 wherein said kiln system further comprises:

a second elongate extending laterally from a leading edge in upper portions of said kiln chamber downwardly toward a second opposed sidewall of said kiln chamber to a trailing edge, and with said second splitter plate having a curved portion between said leading edge and said trailing edge for directing the circulating air along said second splitter plate and then downward about said rectangular stack of lumber placed in said chamber for drying; and means on said leading edge of said second splitter plate for generating a plurality of vortices of air in the air circulated by said fan, whereby the vortices created by said vortex generating means for said second splitter plate help the circulating air to more closely follow the surface of said second splitter plate downwardly about said rectangular stacks of lumber to thereby increase the efficiency of the airflow within said kiln chamber and the drying process.

23. The combination of a kiln system and lumber according to claim 15 and further comprising:

a plurality of laterally spaced rectangular solid stacks of lumber positioned in said kiln chamber to define at least one outermost stack with respect to each vertical sidewall of said kiln chamber;

a second elongate splitter plate extending laterally from a leading edge in upper portions of said kiln chamber downwardly toward a second opposed sidewall of said kiln chamber to a trailing edge, and with said second splitter plate having a curved portion between said leading edge and said trailing edge for directing the circulating air along said second splitter plate and then downward about said outermost rectangular stacks of lumber placed in said chamber for drying; and means on said leading edge of said second splitter plate for generating a plurality of vortices of air in the air circulated by said fan, whereby the vortices created by said vortex generating means for said second splitter plate help the circulating air to more closely follow the surface of said second splitter plate downwardly about the outermost rectangular stacks of lumber to thereby increase the efficiency of the airflow within said kiln chamber and the drying process.

24. An elongate splitter plate for directing air circulated by a fan through a kiln chamber and along said splitter plate and then downward about a rectangular solid stack of lumber enclosed in the kiln chamber, to thereby increase the efficiency of the airflow within said kiln chamber and the drying process of the stack of lumber said elongate splitter plate comprising:

a horizontally disposed first edge in upper portions of the kiln chamber;

a vertically disposed second edge;

a curved portion extending both laterally from said first edge toward a sidewall of the kiln chamber arid downwardly about the rectangular stack of lumber to said second edge; and means on said first edge of said splitter plate for generating a plurality of vortices in the air circulated by the fan, whereby the vortices of circulating air created by said vortex generating means more closely follow said curved portion of said splitter plate downwardly about the rectangular stack of lumber.

25. An elongate splitter plate according to claim 24 wherein said vortex generating means comprises a plurality of spaced apart projections extending laterally inward in the kiln chamber.

26. An elongate splitter plate according to claim 25 wherein said plurality of projections comprise a plurality of sawtooth-shaped projections having opposed side edges and extending from a relatively broad first portion laterally inward to a relatively narrow second portion.

27. An elongate splitter plate according to claim 26 wherein said opposed side edges define therebetween an interior angle of between about 16° and about 30°.

28. An elongate splitter plate according to claim 26 wherein the width of said relatively broad first portion of said sawtooth-shaped projections is about 6.75 inches.

29. An elongate splitter plate according to claim 26 wherein the width of said relatively narrow second portion of said sawtooth-shaped projections is about 1 inch.

30. An elongate splitter plate according to claim 26 wherein the length of said sawtooth-shaped projections is between about 6 inches and about 18 inches.

31. An elongate splitter plate according to claim 24 wherein said curved portion of said elongate splitter plate is concave relative to a rectangular stack of lumber in the kiln chamber.

32. An elongate splitter plate according to claim 31 wherein said curved portion of said elongate splitter plate extends radially through a substantially semi-circular arc of about 90°.

33. An elongate splitter plate according to claim 24 wherein the kiln chamber has a length sufficient to receive a charge of lumber comprising of a plurality of rectangular solid stacks of lumber, said charge of lumber having a predetermined maximum length and said elongate splitter plate has a length substantially equal to the predetermined maximum length of said charge of lumber.

34. A method of increasing the efficiency of drying green lumber, comprising the steps of:

circulating air through a rectangular solid stack of lumber in a sealed kiln chamber in which air can be controllably introduced into and exhausted from the kiln chamber to thereby draw moisture from the stack of lumber; and generating a plurality of vortices of air at a splitter plate from the air circulating through the kiln chamber such that the plurality of air vortices more readily follow the splitter plate downwardly about the rectangular stack of lumber to thereby increase the efficiency of airflow within the kiln chamber and the drying process.

35. A method of drying lumber according to claim 34 further comprising the step of directing the plurality of air vortices downwardly about and along a surface of a splitter plate and then downward about the rectangular solid stack of lumber.

36. A method of drying lumber according to claim 35 wherein the step of directing the circulating air along the splitter plate further comprises the step of guiding at least a portion of the air more closely over both the upper and lower surfaces of the splitter plate.

37. A method of drying lumber according to claim 34 further comprising the step of recirculating at least a portion of the air through the stack of lumber in said kiln chamber to further dry each stack of lumber.

38. A method of drying lumber according to claim 37 wherein the step of recirculating the air comprises the steps of selectively exhausting a portion of the circulating air containing moisture drawn from the stack of lumber and introducing additional air into the kiln chamber wherein the additional air has a lower moisture content than the exhausted air.

39. A method of drying lumber according to claim 34 further comprising the step of heating the air prior to its circulation to facilitate moisture removal from each the stack of lumber.

40. A method of increasing the efficiency of drying rectangular solid stacks of green lumber in a sealed kiln chamber in which air circulates along a splitter plate to draw moisture from the stacks of lumber, the method comprising generating a plurality of vortices of air at the splitter plate from the air circulating through the kiln chamber so as to create a turbulent boundary layer of air about the splitter plate such that the axial momentum of the air within the boundary layer increases and the vortices of circulating air more closely follow a surface of the splitter plate downward about the rectangular stacks of lumber.

41. A method of drying lumber according to claims 40 further comprising the step of directing the circulating air about and along both the upper and lower surfaces of the splitter plate.

42. A method of drying lumber according to claim 40 further comprising the step of recirculating at least a portion of the air that has passed through the stack at least once to further dry the stack of lumber.

43. A method of drying lumber according to claim 40 further comprising the step of controllably introducing air into the kiln chamber and controllably exhausting air from the kiln chamber, whereby the air introduced has a lower moisture content than the air exhausted.

44. A method of drying lumber according to claim 40 further comprising the step of heating the air prior to its circulation to facilitate moisture removal from the stack of lumber.

* * * * *